United States Patent [19]

Eggelsmann

[11] 4,115,718

[45] Sep. 19, 1978

[54] ROTARY-ANODE X-RAY TUBE

[75] Inventor: Harry Eggelsmann, Hamburg, Germany

[73] Assignee: U.S. Philips Corporation, New York, N.Y.

[21] Appl. No.: 776,260

[22] Filed: Mar. 10, 1977

[30] Foreign Application Priority Data

Mar. 13, 1976 [DE] Fed. Rep. of Germany ..... 2610660

[51] Int. Cl.[2] ..... H01J 35/10

[52] U.S. Cl. ..... 313/60; 313/149

[58] Field of Search ..... 313/60, 149

[56] References Cited

U.S. PATENT DOCUMENTS 3,942,059 3/1976 Tran-Quang ..... 313/60

*Primary Examiner*—Rudolph V. Rolinec
*Assistant Examiner*—Darwin R. Hostetter
*Attorney, Agent, or Firm*—Frank R. Trifari; Algy Tamoshunas

[57] ABSTRACT

In rotary anodes which are journalled on two sides a problem occurs, notably as regards the bearing which is arranged on the side of the anode disc which is remote from the rotor. The problem involves excessive discharge of heat via the shaft and the bearing. A possibility of reducing the quantity of heat applied to the bearing consists in the increasing of the length of the anode shaft to increase the heat resistance. However, the length of the X-ray tube is then also increased. The invention provides a combination of smaller length, substantially free choice of the material of the anode shaft and hence overcritical speeds for the tube during operation by forming the anode shaft as a hollow rotor shaft coupled to the anode disc and a further shaft journalled at both ends to the respective bearings and connected to the hollow shaft.

5 Claims, 2 Drawing Figures

ROTARY-ANODE X-RAY TUBE

Figure 1:
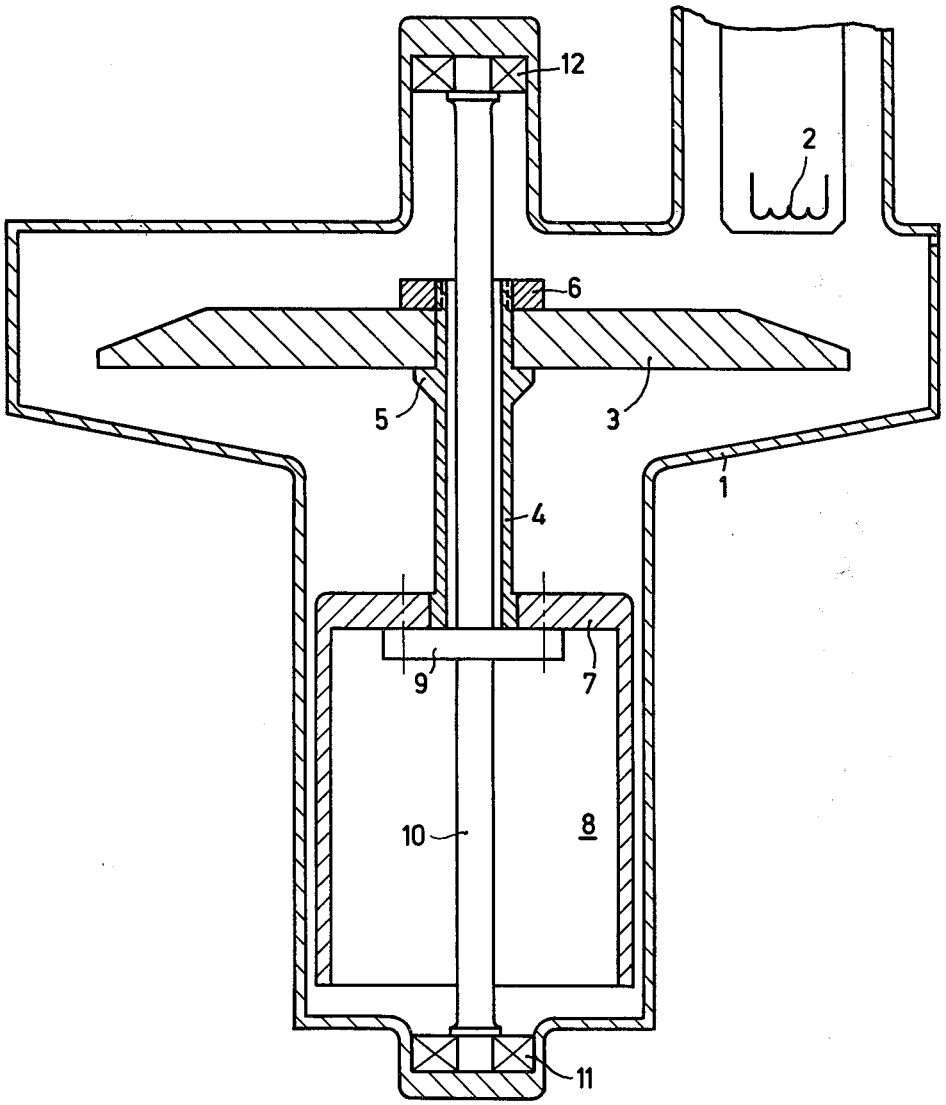

The invention relates to a rotary-anode X-ray tube, comprising a rotary anode which is journalled on two sides, the anode disc being mounted on a hollow shaft.

An X-ray tube of this kind is known, for example, from British Patent Specification No. 1,232,160. The temperature of the bearings which are arranged one on each side of the anode disc may not exceed a value of approximately 300° C. This value, however, is already reached when an amount of energy of only a few Watts is transported via the bearings. However, because in the anode disc a few hundreds of Watts are converted into heat during fluoroscopy, and even 100 kW or more in the case of a short exposure, high heat resistance is desirable between the anode disc and the bearings on each side of the anode disc. Thus, it is necessary that only a very small fraction of the heat must be dissipated through the bearings, while the largest part being dissipated by radiation from the anode disc.

In order to achieve such a high heat resistance, known rotary anode X-ray tubes utilize an anode disc having a central boring with a diameter which is substantially larger than the outer diameter of the hollow shaft. The anode disc is then connected to the hollow shaft by way of disc-shaped rings having a high heat resistance. It will be obvious that in a device of this kind it is difficult to position the anode disc exactly concentrically relative to the hollow shaft and thus avoid unbalance. This is notably applicable if comparatively thin discs are used in order to obtain high heat resistance. A rotary anode construction of this kind, therefore, has not been successfully applied in practice thus far.

The increase in heat resistance by the reduction of the cross-section of a shaft supporting the anode disc is limited by the required mechanical rigidity. The only remaining solution is to prolong the shaft until the required heat resistance is reached. However, this shaft must then be comparatively long, notably on the side of the anode disc which is remote from the rotor. This is because the rotor intensifies the heat transportation between the anode disc and the bearings by the radiation of heat, so that the dimensions of the X-ray tube are substantially increased.

The invention has for its object to provide a rotary-anode X-ray tube in which a comparatively small distance exists between the bearings, particularly between the anode disc and the bearing which is remote from the rotor, which offers adequate heat resistance between the anode disc and the two bearings, and which is mechanically stable.

To this end, the present invention provides a rotary-anode X-ray tube with a shaft which is concentrically arranged in and connected to the hollow shaft, and which is journalled, either directly or via intermediate elements, in bearings on both sides of the anode disc.

Therefore, the shaft which is journalled in the bearings either directly or via intermediate elements is not connected directly to the anode disc, but rather via the hollow shaft. The heat resistance between the anode disc and the bearings is thus substantially increased.

However, notably the heat resistance between the anode disc and the part of the shaft which is present in the boring of the anode disc is also substantially increased. The transfer of heat is then effected mainly by radiation between the inner surface of the hollow shaft and the surface of the inner shaft. The temperature in this region of the shaft is thus substantially lower than if the shaft were connected directly to the anode disc. Therefore, the shaft may be made of a material which need not have the same temperature resistance as the material of the elements which are directly connected to the anode disc. Consequently, use can be made of a material having a heat conductivity which is substantially lower than that of molybdenum which is commonly used to manufacture the elements which are connected directly to the anode disc, because molybdenum is one of the few materials which still have the required resistance at the temperature of approximately 1500° C which may occur at the area of the boring in the anode disc. For example, types of steel having a comparatively high chromium content are thus also feasible.

In a preferred embodiment of the device in accordance with the invention, the shaft is made of chromium steel. The hollow shaft may then be made of molybdenum. The heat conductivity of chromium steel amounts to approximately 1/9 of that of molybdenum, i.e. for the same cross-section and the same heat resistance, the chromium steel shaft may be shorter than a shaft of molybdenum by this factor.

In a further preferred embodiment of the rotary-anode X-ray tube in accordance with the invention, the area of connection between the hollow shaft and the shaft of the rotor of the rotary-anode X-ray tube is enclosed, the rotor being connected to the hollow shaft in a suitable thermally conductive manner. As a result, a substantial part of the heat of the anode disc is transferred via the hollow shaft to the rotor which discharges the heat mainly by radiation particularly, if the rotor has the usual cylindrical shape and is made of a metal having a high thermal emissive power. It can thus be achieved that only a small part of the heat applied to the anode is transferred to the shaft.

As has already been stated, a rotary anode construction in accordance with the invention offers a high degree of freedom as regards the choice of the material of the shaft as well as of the proportioning of its cross-section and, beyond a minimum value, also as regards its length. As a result, favorable conditions are obtained for the use of a so-termed overcritically loaded rotary shaft which is known as a Laval shaft. In a further preferred embodiment in accordance with the invention, the shaft is proportioned so that the operating speed lies in the overcritical range. The critical speed is the speed at which the deflection of the anode disc, caused by the continuous unbalance of the anode disc and the shaft, is maximum. The overcritical speed range lies beyond the critical speed, and, if the speed is sufficiently higher than the critical speed, this deflection, resulting in vibrations and loud running noise, can be reduced to a value which cannot be reached in the sub-critical speed range, i.e. at speeds below the critical speed.

In a further preferred embodiment in accordance with the invention, the hollow shaft and the shaft are connected to the rotor jacket via a suitable thermally conductive, electrically insulating body, the rotor jacket being connected to a bearing. The insulator between the anode disc and the rotor thus enables separation of the potentials of the rotor jacket and the anode disc. For example, the bearing connected to the rotor jacket may be grounded, so that the rotor jacket is also grounded, while the anode disc carries high voltage potential. This is particularly advantageous for applications where the anode disc must carry high voltage potential and where at the same time a high drive power is required for driving the anode. This is because the rotor then has the same potential as the stator, so that the air gap between the rotor and the stator, which influences the drive efficiency, can be minimized.

The invention will be described in detail hereinafter with reference to the accompanying diagrammatic drawing.

Figure 2:
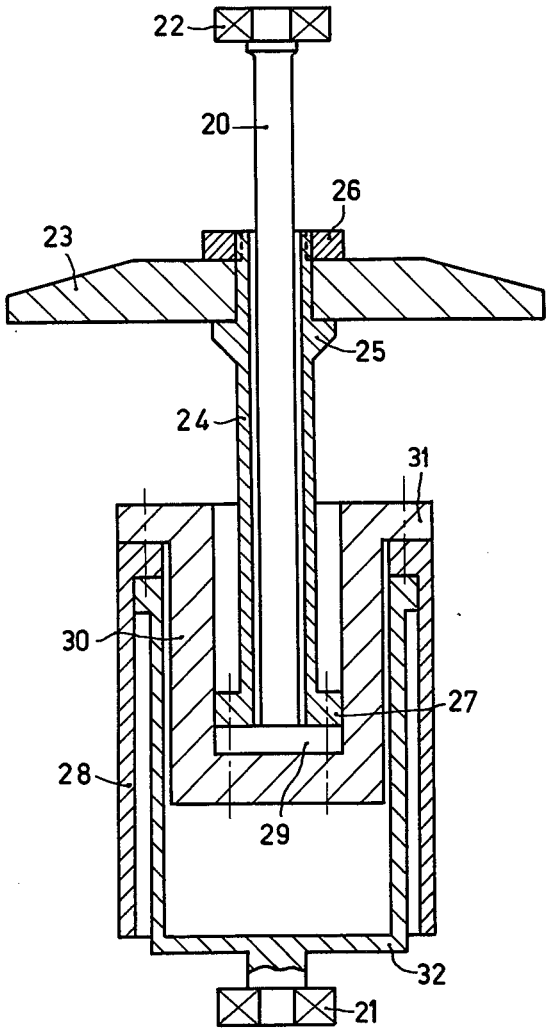

FIG. 1 is a cross-sectional view of a first embodiment in accordance with the invention, and FIG. 2 is a cross-sectional view of an anode portion of a further embodiment of an X-ray tube in accordance with the invention.

The reference 1 in FIG. 1 denotes a metal envelope of a rotary anode X-ray tube, and the reference 2 denotes a cathode of the X-ray tube which is connected to the tube envelope by way of an insulator (not shown). An anode disc 3 is connected to a hollow shaft 4 which is for this purpose provided with a flange-like portion 5, the anode disc 3 is pressed against the flange-like portion 5 by means of a nut 6. An end of the hollow shaft 4 which is remote from the anode is connected to an end face 7 of a cylindrical rotor 8. The end face 7 of the rotor jacket also has connected to it a flange 9 of a shaft 10 which is passed through the hollow shaft and the rotor jacket, for example, by way of screwing. The ends of this shaft are journalled in ball bearings 11 and 12 which are connected to the tube envelope 1.

It will be obvious that in this case the heat is not directly transferred from the anode disc to the shaft 10, but rather via the hollow shaft 5 which is preferably made of a temperature-resistant metal, preferably molybdenum. The heat discharged via the hollow shaft is radiated for the better part via the rotor 8 which is in suitable thermal contact with the hollow shaft, so that the temperature on the flange 9 of the shaft 10 is already comparatively low. Therefore, the requirements as regards temperature resistance imposed on this material need not be as severe as those imposed on the hollow shaft, so that a larger degree of freedom exists as regards the choice of a suitable material. For example, use can be made of chromium steel which has a substantially lower heat conductivity than molybdenum, so that the distance of the bearings, but notably the distance between the ball bearing 12, arranged on the side of the anode disc which is remote from the rotor, and the anode disc may be very small, without the bearing temperature reaching prohibitive values during operation of the X-ray tube.

As far as its cross-section, its length and the material properties are concerned, the shaft can also be constructed as a bending elastic shaft. In the case of such a shaft, the operating speed may be chosen to be substantially higher than the critical speed. The X-ray tube then operates in the so-termed overcritical speed range, so that particularly quiet rotation is ensured. A rotary torque produced by a stator (not shown in FIG. 1), arranged outside the tube envelope at the area of the rotor, is then transferred directly, via the hollow shaft 4, to the anode disc, so that the shaft 10 remains substantially free from torsional loading.

The operation in the overcritical speed range can in principle also be achieved, however, by flexibly connecting at least one of the bearings to the tube envelope and by imparting a given play to this bearing in the longitudinal direction of the shaft in order to enable compensation for the expansion of the shaft due to heating.

In the embodiment in accordance with the invention which is shown in FIG. 1, the rotor and the anode disc carry the same potential. As a result, in the case of a metal tube envelope and direct contact between the ball bearings and the tube envelope, the anode disc is referenced to the same potential as the tube envelope, a ground potential.

FIG. 2 shows an anode portion of an X-ray tube in accordance with the invention, in which the anode disc and the rotor may carry a different potential. For example, the rotor may be grounded and the anode may carry a positive high voltage potential. Thus, on the one hand an advantage is obtained in that use can be made of a symmetrical high voltage generator which generates a symmetrical high voltage with respect to earth potential, while on the other hand the air gap between the rotor and the stator, generally at ground potential, may be comparatively small, so that a high drive efficiency is obtained.

The anode disc 23 is again mounted between a nut, screwed onto the thread on the end of the hollow shaft, and a flange on the hollow shaft which is made, for example, of molybdenum. The hollow shaft 24 terminates in a flange 27 which is connected, by way of a screwed connection, to a flange 29 on the end of a solid shaft 20 which is concentrically arranged in the hollow shaft 24, and also to an insulator 30. An end of the shaft 20 which projects from one end of the hollow shaft on the side of the anode is journalled in a ball bearing 22 which is supported by a tube envelope (not shown). A bowl-shaped insulator 30 encloses the hollow cylinder and the shaft on one end, and comprises, on a side which faces the anode disc, a flange 31 which is connected to flanges of a cylindrical rotor 28 and to a sleeve 32 which is concentrically arranged in the rotor 28 and which encloses the insulator 30. The sleeve 32 is journalled in a bearing 21.

The insulator 30 is preferably made of a material having a low heat resistance, so that a comparatively large part of the heat supplied via the hollow shaft flows, via the insulator 30, to the rotor 28 where it is discharged by radiation. The bowl-shaped portion 32 is preferably made of a material having a high heat resistance, in order to form a thermal shield for the ball bearing 21. If the tube envelope is made of metal, which offers special advantages, the ball bearing 21 may be directly connected to the tube envelope. The ball bearing 22, however, carries high voltage potential which is applied to the anode disc via the shaft 20 and the hollow shaft 24. In the case of a metal tube envelope, the ball bearing is then arranged in an insulator which is connected to the tube envelope and which is not shown in FIG. 2.

What is claimed is:

1. A rotary-anode X-ray tube, comprising a rotary anode which is journalled on two sides and including an anode disc mounted on a hollow shaft, a further shaft concentrically arranged in said hollow shaft and connected to said hollow shaft, said further shaft being journalled for connection to bearing means arranged on both sides of the anode disc.

2. The rotary-anode X-ray tube as claimed in claim 1, wherein the connection area between said hollow shaft and said further shaft is enclosed by a rotor segment which is thermally conductively connected to said hollow shaft.

3. The rotary-anode X-ray tube as claimed in claim 1, wherein the operating speed of said further shaft lies in the overcritical speed range.

4. The rotary-anode X-ray tube as claimed in claim 1, wherein said hollow shaft is made of molybdenum, and said further shaft is made of chromium steel.

5. The rotary-anode X-ray tube as claimed in claim 1, wherein said hollow shaft and said further shaft are connected to a rotor jacket segment via a suitable thermally conductive electrically insulating body, and means connecting said rotor segment to one of said bearing means.

* * * * *